US005980068A

United States Patent [19]

Yu

[11] Patent Number: 5,980,068

[45] Date of Patent: Nov. 9, 1999

[54] LAMP DEVICE HAVING A DETACHABLE LAMP SHADE

[76] Inventor: Jack Yu, No. 109-1, Avenue 6, Lane 164, Tzong Sa Rd., Da du Hsiang, Taichung Hsien, Taiwan

[21] Appl. No.: 08/938,762

[22] Filed: Sep. 26, 1997

[51] Int. Cl.[6] ..... F21V 11/00

[52] U.S. Cl. ..... 362/351; 362/353

[58] Field of Search ..... 362/351, 353

[56] References Cited

U.S. PATENT DOCUMENTS 2,066,771 1/1937 Doane ..... 362/351

FOREIGN PATENT DOCUMENTS 2211564 9/1973 Germany ..... 362/351

*Primary Examiner*—Cassandra Spyrou
*Assistant Examiner*—Fayez Assaf

[57] ABSTRACT

A lamp device includes a light bulb secured to a lamp base and a lamp shade having one or more hooks for engaging with the lamp base and for allowing the lamp shade to be easily disengaged from the lamp base. The lamp base includes a shell extended downward from the bottom peripheral portion for forming an annular groove between the lamp base and the shell and for engaging with the hooks. A projection extends into the annular groove for engaging with the hooks and for allowing the lamp shade to rotate the lamp base without contacting the hand with the light bulb.

10 Claims, 3 Drawing Sheets

LAMP DEVICE HAVING A DETACHABLE LAMP SHADE

BACKGROUND OF THE INVENTION

1. Field of the Invention

The present invention relates to a light device, and more particularly to a light device having a detachable lamp shade.

2. Description of the Prior Art

Typical light devices, particularly the light devices that may generate high light intensity and that requires low power, includes one or more light tubes or light bulbs extended outward of a base and having no lamp shade for covering the light bulbs, such that the user may be hurt by the light bulb inadvertently. In addition, the light bulb may generate a great heat and may not be easily rotated or disengaged from the lamp base due to the great heat of the light bulb.

The present invention has arisen to mitigate and/or obviate the afore-described disadvantages of the conventional lamp devices.

SUMMARY OF THE INVENTION

The primary objective of the present invention is to provide a lamp device having a lamp shade for allowing the lamp device to be rotated without contacting with the light bulb.

In accordance with one aspect of the invention, there is provided a lamp device comprising a lamp base, a light bulb secured to the lamp base, and a lamp shade including hook means for engaging with the lamp base and for securing the lamp shade to the lamp base.

The lamp base includes a bottom peripheral portion having a shell extended downward, and an annular groove formed between the lamp base and the shell for engaging with the hook means. The shell includes at least one projection extended inward of the annular groove for engaging with the hook means and for allowing the lamp shade to rotate the lamp base. The shell includes at least one notch for allowing the hook means to be disengaged from the annular groove of the lamp base.

The lamp base includes at least one cavity for engaging with the hook means and for allowing the lamp shade to be secured to the lamp base and for allowing the lamp base to be rotated by the lamp shade.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
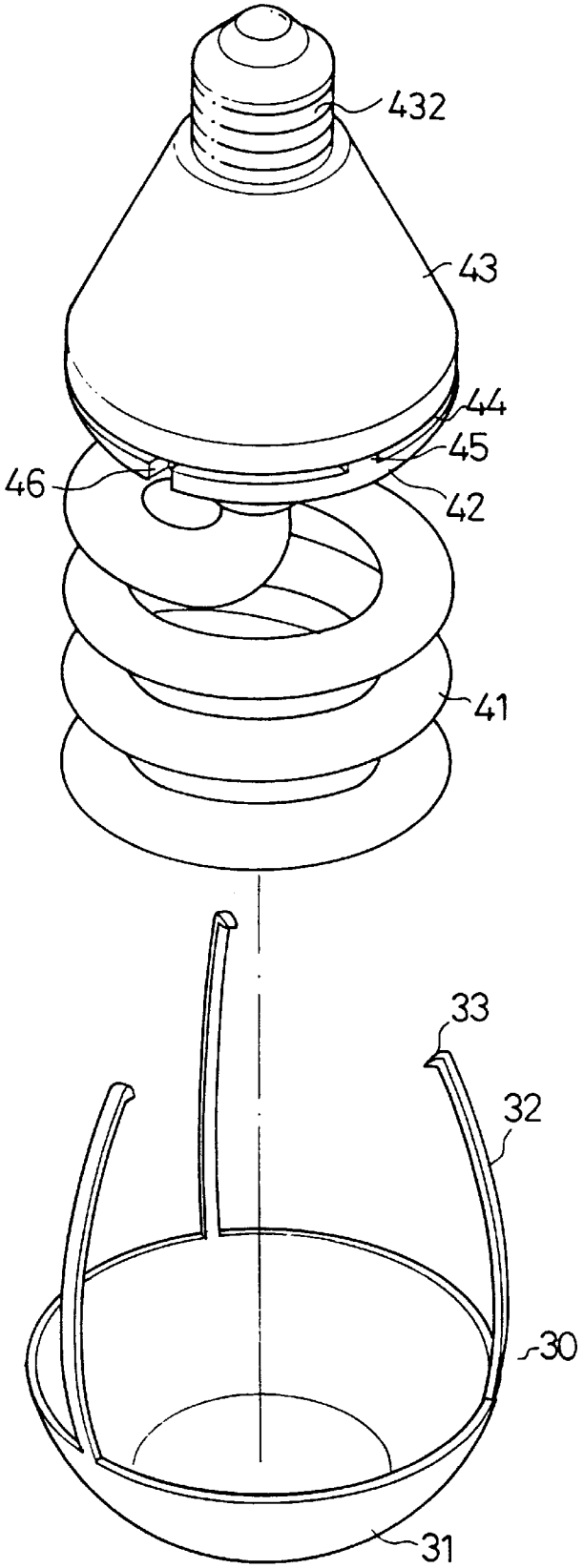
FIG. 1 is an exploded view of a lamp device in accordance with the present invention.
Figure 3:
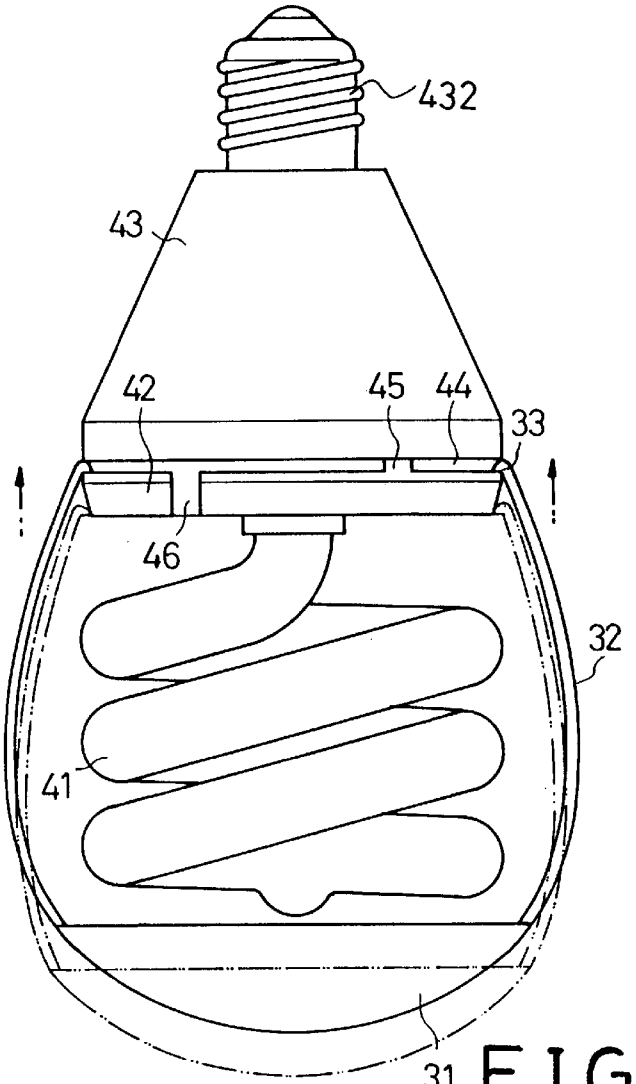
FIGS. 3, 4 and 5 are plane views illustrating the operation of the lamp device.
Figure 2:
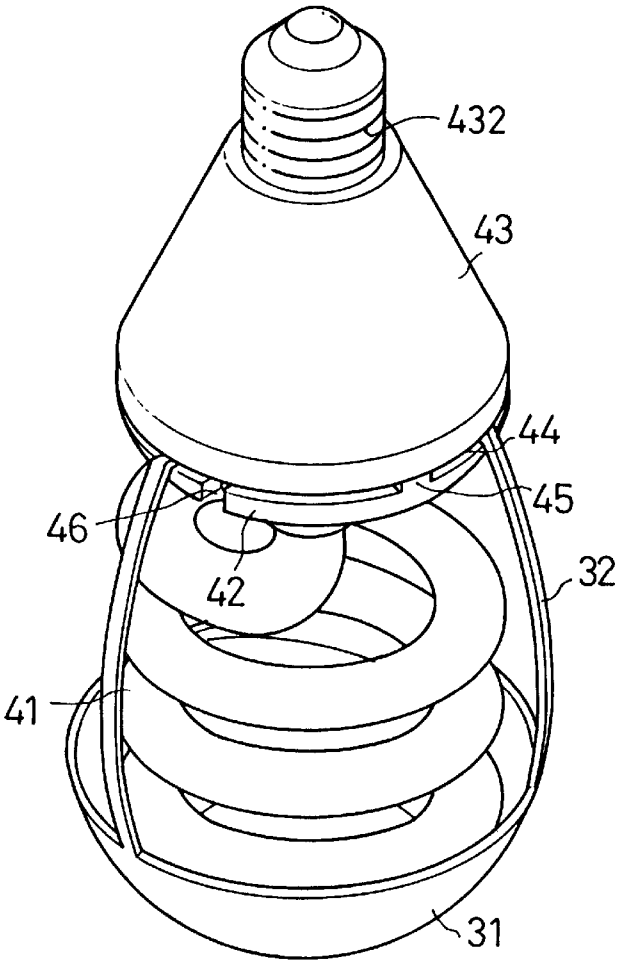
FIG. 2 is a perspective view of the lamp device.

Referring to the drawings, and initially to FIGS. 1–3, a lamp device in accordance with the present invention comprises a lamp base 43 including a coupler 432 extended upward for coupling to a lamp socket. The lamp base 43 includes a shell, such as an annular shell 42 extended downward from the bottom peripheral portion and includes an annular groove 44 formed between the shell 42 and the lamp base 43. The shell 42 includes one or more projections 45 extended upward and inward of the annular groove 44 and includes two or more notches or cavities 46 communicating with the annular groove 44. A light bulb 41 is secured to the shell 42 and/or the lamp base 43. It is to be noted that the shell 42 may be a separate member from the lamp base 43 for securing the light bulb 41 to the lamp base 43, and the projections 45 are provided for forming and for maintaining the annular groove 44.

Figure 5:
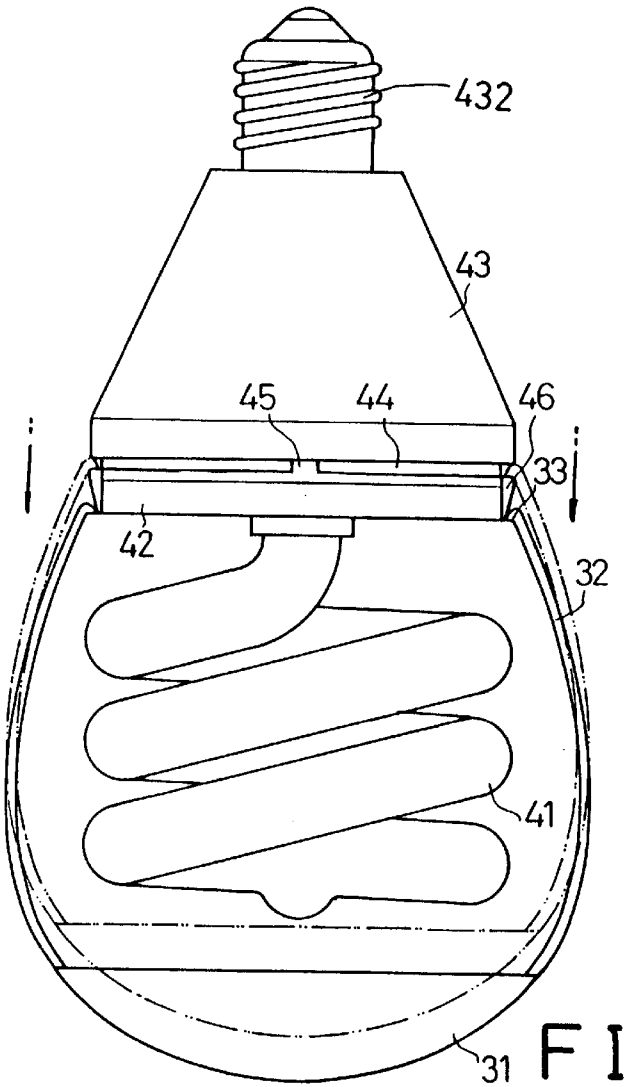

A lamp shade 30 includes a bottom 31 having a curved or semi-spherical configuration and includes two or more extensions 32 extended upward. The extensions 32 are resilient and each includes a hook 33 provided on top for engaging with the annular groove 44 via the notches 46. It is to be noted that, without the notches 46, the hooks 33 of the extensions 32 may also be engaged over the shell 42 (FIG. 3) for engaging with the annular groove 44 and for securing the lamp shade 30 to the lamp base 43. As shown in FIG. 5, the provision of the notches 46 allows the hooks 33 of the extensions 32 to be easily engaged with and disengaged from the annular groove 44 (FIG. 5).

It is to be noted that, instead of the annular groove 44, the lamp base 43 may include two or more cavities 44 for engaging with the hooks 33 of the extensions 32 and for allowing the lamp shade 30 to be secured to the lamp base 43 and for allowing the lamp shade 30 to rotate the lamp shade 43.

Figure 4:
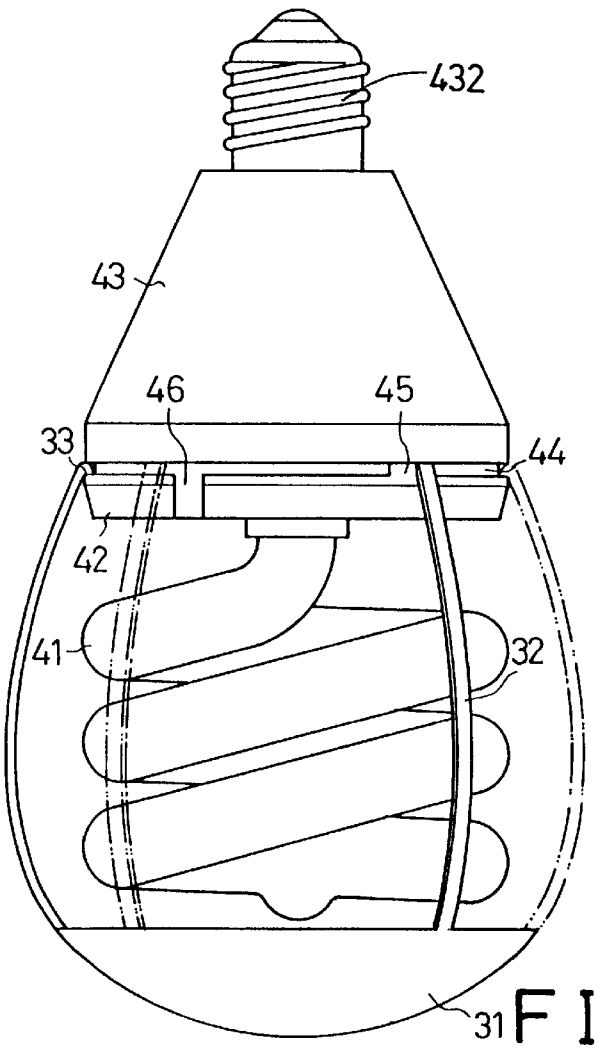

Referring next to FIG. 4, when the hooks 33 of the extensions 32 are engaged with the projection(s) 45, the lamp shade 30 may be used for rotating the lamp base 43 and for allowing the coupler 432 of the lamp base 43 to be easily engaged with and disengaged from the lamp socket without contacting the hand with the light bulb 41.

Accordingly, the lamp device includes a lamp shade that may be easily engaged and disengaged from the lamp base and that may be used for rotating the lamp base.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lamp device comprising:

a lamp base, a light bulb secured to said lamp base, and a lamp shade including hook means for engaging with said lamp base and for securing said lamp shade to said lamp bases, said lamp base including a bottom peripheral portion having a shell extended downward from said bottom peripheral portion, and including an annular groove formed between said lamp base and said shell for engaging with said hook means and for allowing said lamp shade to be secured to said lamp base.

2. The lamp device according to claim 1, wherein said shell includes at least one projection extended inward of said annular groove for engaging with said hook means and for allowing said lamp shade to rotate said lamp base when said hook means is engaged with said at least one projection.

3. The lamp device according to claim 1, wherein said shell includes at least one notch for engaging with said hook means and for allowing said hook means to be engaged in and disengaged from said annular groove of said lamp base.

4. The lamp device according to claim 1, wherein said lamp base includes at least one cavity for engaging with said hook means and for allowing said lamp shade to be secured to said lamp base and for allowing said lamp base to be rotated by said lamp shade.

5. A lamp device comprising:

a lamp base, a light bulb secured to said lamp base, and a lamp shade including at least two extensions, said extensions including hook means for engaging with said lamp base and for securing said lamp shade to said lamp base, said lamp base including a bottom peripheral portion having a shell extended downward from said bottom peripheral portion, and including an annular groove formed between said lamp base and said shell for engaging with said hook means of said at least two extensions and for allowing said lamp shade to be secured to said lamp base.

6. The lamp device according to claim 5, wherein said shell includes at least one projection extended inward of said annular groove for engaging with said hook means and for allowing said lamp shade to rotate said lamp base when said hook means is engaged with said at least one projection.

7. The lamp device according to claim 5, wherein said shell includes at least one notch for engaging with said hook means and for allowing said hook means to be engaged in and disengaged from said annular groove of said lamp base.

8. The lamp device according to claim 5, wherein said lamp base includes at least one cavity for engaging with said hook means and for allowing said lamp shade to be secured to said lamp base and for allowing said lamp base to be rotated by said lamp shade.

9. A lamp device comprising:

a lamp base including a bottom portion, a shell secured to said bottom portion of said lamp base for defining an annular groove between said lamp base and said shell, a light bulb secured to said lamp shell, and a lamp shade including hook means for engaging with said annular groove and for securing said lamp shade to said lamp base.

10. The lamp device according to claim 9, wherein said shell includes at least one projection extended inward of said annular groove for engaging with said hook means and for allowing said lamp shade to rotate said lamp base when said hook means is engaged with said at least one projection.

* * * * *